US005862685A

United States Patent [19]

Lim

[11] Patent Number: 5,862,685

[45] Date of Patent: Jan. 26, 1999

[54] WASHING MACHINE TRANSMISSION

[75] Inventor: Hee-Tae Lim, Incheon, Rep. of Korea

[73] Assignee: Daewoo Electronics Co., Ltd., Rep. of Korea

[21] Appl. No.: 704,983

[22] Filed: Aug. 29, 1996

[30] Foreign Application Priority Data

Aug. 29, 1995 [KR] Rep. of Korea ..... 1995-22836

[51] Int. Cl.[6] ..... D06F 37/34

[52] U.S. Cl. ..... 68/23.7; 68/133; 74/36

[58] Field of Search ..... 68/23.6, 23.7, 68/133, 134; 74/25, 36

[56] References Cited

U.S. PATENT DOCUMENTS

| | | | |
|---|---|---|---|
| 1,857,871 | 5/1932 | Reaney | 74/36 |
| 2,816,450 | 12/1957 | Conlee | 68/133 |
| 3,604,029 | 9/1971 | Bain | 68/133 |
| 3,771,336 | 11/1973 | Phillips, Jr. | 68/23.7 |
| 4,953,369 | 9/1990 | Ito | 68/23.7 |
| 5,379,616 | 1/1995 | Bae | 68/23.7 |

FOREIGN PATENT DOCUMENTS

| | | | |
|---|---|---|---|
| 527030 | 6/1931 | Germany | 68/23.7 |
| 195380 | 1/1958 | Germany | 68/23.7 |
| 587320 | 1/1959 | Italy | 68/133 |
| 590809 | 4/1959 | Italy | 68/23.7 |
| 60-163691 | 8/1985 | Japan | 687/23.7 |
| 64-32894 | 2/1989 | Japan | 68/23.7 |
| 1-232991 | 9/1989 | Japan | 68/23.7 |
| 2-88099 | 3/1990 | Japan | 68/23.7 |
| 2-237595 | 9/1990 | Japan | 68/23.7 |
| 3-73198 | 3/1991 | Japan | 68/23.7 |
| 4-108497 | 4/1992 | Japan | 68/23.7 |
| 5-68778 | 3/1993 | Japan | 68/133 |

*Primary Examiner*—Frankie L. Stinson

*Attorney, Agent, or Firm*—Cushman Darby & Cushman Intellectual Property Group of Pillsbury Madison & Sutro, LLP

[57] ABSTRACT

A washing machine transmission performs a washing by rotating a pulsator in forward and reverse directions during a washing cycle even though a driving source rotates in any one direction only, so that an overload in the driving source can be prevented. A first link is attached to an upper end of a driving shaft, and has a first guide pin. A second link is hinged to an inner peripheral surface of a brake drum at a first end and has a second guide pin, and has a first oblong slot formed between the first end and the second end. A third link is attached to a driven shaft, and has a second oblong slot. When the driving shaft rotates, the first guide pin rotates. Thus, as the first oblong slot moves along the first guide pin, the second link hinged to the inner peripheral surface of the brake drum rotates in forward and reverse directions in a predetermined range of angles, and the second guide pin attached to the second end of the second link moves along the second oblong slot so as to rotate the third link in forward and reverse directions in a range of angles that is lager than that of the second link.

18 Claims, 3 Drawing Sheets

WASHING MACHINE TRANSMISSION

BACKGROUND OF THE INVENTION

1. Field of the Invention

The present invention relates to a washing machine transmission, more particularly to a washing machine transmission which performs a washing by rotating a pulsator in forward and reverse directions even if a driving source rotates in one direction only during a washing cycle, and which prevents an overloading of the driving source.

2. Description of the Prior Art

In general, various kinds of transmissions have been proposed for rotating the pulsator in forward and reverse directions during the washing cycle and for rotating a spin tub during a spin cycle.

The transmission of a fully automatic washing machine according to the prior art comprises a dual axle structure which is supported by bearings and has a washing output axle connected to a pulsator and a spin output axle connected to a spin tub. The transmission of the fully automatic washing machine only rotates the washing output axle clockwise and counterclockwise during the washing cycle and rotates the spin output axle along with the washing output axle in the same direction during the spin cycle by way of a connection with a clutch spring. The transmission comprises a one way clutch for transmitting power so that the spin output axle is rotated only in a spin rotating direction and is prevented from rotating in a reverse direction.

The transmission of the washing machine according to the prior art performs a washing by way of forward and reverse rotation of the driving source to thereby rotate the pulsator clockwise and counterclockwise during the washing cycle, and performs a spinning by way of rotation of the driving source to thereby rotate the pulsator and the spin tub in any one direction simultaneously during the spin cycle.

Accordingly, in the transmission of the washing machine according to the prior art, the driving source is rotated in forward and reverse directions to thereby rotate the pulsator, so that various problems such as an overload in the driving source and a shortening of the life cycle of the driving source have arisen.

U.S. Pat. No. 5,379,616 (issued to Sang-Chul Bae on Jan. 10, 1995) discloses a power transfer apparatus of a fully automatic washing machine which can perform a washing by rotating a washing means in forward and reverse directions during a washing cycle even though a driving source rotates only in a first direction, and which can perform a spinning when the driving source is rotated in a second direction to thereby rotate the washing means and the spin tub in the second direction, so an overload in the driving source can be prevented and the life of the driving source can be extended.

In Bae's Patent, the transmission, as illustrated in FIG. 1, comprises a driving shaft 40 with a connecting mechanism which has cases 7 and 9, a clutch means 54, a conversion member 30, gear arrangements 32, 41 and 42, a rack member 20, a guide unit 31, and a band brake 4. In Bae's transmission, when power is transmitted from the driving source (not shown) to driving shaft 40 so that driving shaft 40 rotates in the first direction during a washing, band brake 4 clutches a periphery of a transfer case member 60 so that the transfer case member 60 is prevented from rotating, and gear arrangements 32, 41 and 42 transmit a rotation of driving shaft 40 to the conversion member 30. The rack means 20 is rectilinearly reciprocated along a track of guide unit 31 formed on the conversion member 30 eccentrically from an axis of the conversion member 30. Thus, driven shaft 10 is rotated in forward and reverse directions by means of a gear 11 of the driven shaft 10 engaged with rack gear 21 of the rack member 20 so that the washing member (not shown) coupled with driven shaft 10 also is rotated in forward and reverse directions.

The driving source rotates in the second direction and band brake 4 releases a braking of transfer case member 60 during the spin cycle so that driving shaft 40 and spin tub shaft 62 connected to transfer case member 60 rotate in the same direction simultaneously, thereby performing the spinning.

In Bae's transmission, the driving source is rotated only in any one direction during the washing so that an overload in the driving source can prevented. But the transmission has a complex structure and the driving source substantially has different rotating directions during the washing and spinning cycles respectively.

SUMMARY OF THE INVENTION

The present invention has been made to overcome the above described problem of the prior art. It is an object of the present invention to provide a washing machine transmission which can perform a washing by rotating a pulsator in forward and reverse directions during a washing cycle even though a driving source rotates only in any one direction, so that an overload in the driving source can be prevented and the life of the driving source can be extended.

To accomplish the above object of the present invention, there is provided a washing machine transmission which comprises:

- a housing mounted on a lower portion of an outer tub;
- a brake drum extending through a lower surface of the housing and supported by the housing;
- a spin tub shaft which is connected to the spin tub at an upper portion of the spin tub shaft and is screwed to an upper portion of the brake drum at a lower portion of the spin tub shaft, for rotating a spin tub in a first direction;
- a driving shaft which extends through the brake drum, is coupled with a belt pulley at a lower end of the driving shaft, and rotates in the first direction for having power transmitted from a driving source;
- a driven shaft which extends through the spin tub shaft and is coupled with a pulsator at an upper end of the driven shaft, for rotating the pulsator in forward and reverse directions; and
- a power transmitting means for connecting the driving shaft and the driven shaft, transmitting a rotation of the driving shaft, which rotates in the first direction, to the driven shaft, and rotating the driven shaft in forward and reverse directions.

The power transmitting means comprises a first link which is attached to an upper end of the driving shaft at a first end, for rotating with the driving shaft, a second link which is hinged to an inner peripheral surface of the brake drum at a first end of the second link and is connected to the first link, for rotating in forward and reverse directions in a predetermined range of angles according to the rotating of the first link, and a third link which is attached to the driven shaft at a first end of the third link and is coupled with the second link at a second end of the third link, for rotating in forward and reverse directions.

A first guide pin, which guides the second link, is mounted on a second end of the first link.

The second link has a through hole for a hinge joint formed at the first end and has a second guide pin mounted on a second end, wherein a first oblong slot is formed between the through hole and the second guide pin so that the first guide pin of the first link is movably inserted into the first oblong slot.

The first link is shorter in length than the second link.

A second oblong slot is formed at the second end of the third link so that the second guide pin of the second link is movably inserted into the second oblong slot.

A second oblong slot is shorter in length than the first oblong slot.

The range of angle at which the third link rotates in forward and reverse directions is larger than the range of angle at which the second link rotates in forward and reverse directions.

The washing machine transmission may further have a clutch spring for connecting the driving shaft to the brake drum so that power is transmitted to the brake drum.

An upper portion of the clutch spring is wound on an outer peripheral surface of a shaft portion of the brake drum.

In the washing machine transmission according to the present invention, as illustrated above, the power is transmitted from the driving source through the belt pulley to the driving shaft when the driving source rotates in any direction during the washing cycle. At that time, a brake band control device operates so that the brake band makes contact with the brake drum, thereby the brake drum is prevented from rotating. Thus, the spin tub shaft coupled with the brake drum and the spin tub mounted on an upper end of the spin tub shaft do not rotate. On the other hand, the driving shaft having the power transmitted from the driving source rotates in the same direction as a rotating direction of the driving source, and the first link attached to the upper end of the driving shaft also rotates around the axis of the driving shaft. Therefore, the first guide pin mounted on the second end of the first link guides the first oblong slot of the second link hinged to the brake drum, with rotating. Thus, the second link rotates in forward and reverse directions around a hinge point in the predetermined range of angles.

Since the third link connects to the second link in such a manner that the first end of the third link is attached to the driven shaft, which is concentric with the driving shaft, and that the second end of the third link is connected with the second guide pin of the second link through the second oblong slot, when the second link rotates in forward and reverse directions around the hinge point, the third link rotates in forward and reverse directions around the axis of the driven shaft in the predetermined range of angles. During this, the angle range of the third link is larger than the angle range of the second link. Thus, the pulsator mounted on the upper end of the third link rotates in the range of angles in which the third link rotates in forward and reverse directions.

During the spin cycle, as a result of a control signal of an ECU (Electronic Control Unit), the clutch spring control device makes contact with the clutch spring with the coupling attached to a lower portion of the driving shaft and a lower portion of the brake drum connected to the spin tub shaft simultaneously. At this time, the brake band, which has been braking the brake drum, releases the braking of the brake drum. Thus, the power of the driving source is transmitted to the driving shaft and the spin tub shaft, so the spin tub rotates, and the spin cycle is performed. Of course, since the ECU only operates the clutch spring control device during the washing cycle, the clutch spring is now in the released state. Therefore, the power of the driving source is transmitted to the pulsator through the driving shaft and driven shaft only during the washing cycle in order to perform the washing cycle.

As described above, the washing machine transmission according to the present invention can perform the washing cycle by rotating the pulsator in forward and reverse directions during a washing cycle even though the driving source rotates only in any one direction only, and can perform the spin cycle by rotating the pulsator and the spin tub simultaneously in the same direction as the rotating direction of the driving source during the spinning cycle. Thus, an overload in the driving source can be prevented and the life of the driving source can be extended.

BRIEF DESCRIPTION OF THE DRAWINGS

The above object and other advantages of the present invention will become more apparent by describing in detail the preferred embodiment thereof with reference to the attached drawings, in which.

DESCRIPTION OF THE PREFERRED EMBODIMENT

Hereinafter, a preferred embodiment of the present invention will be described in detail with reference to the accompanying drawings.

Figure 1:
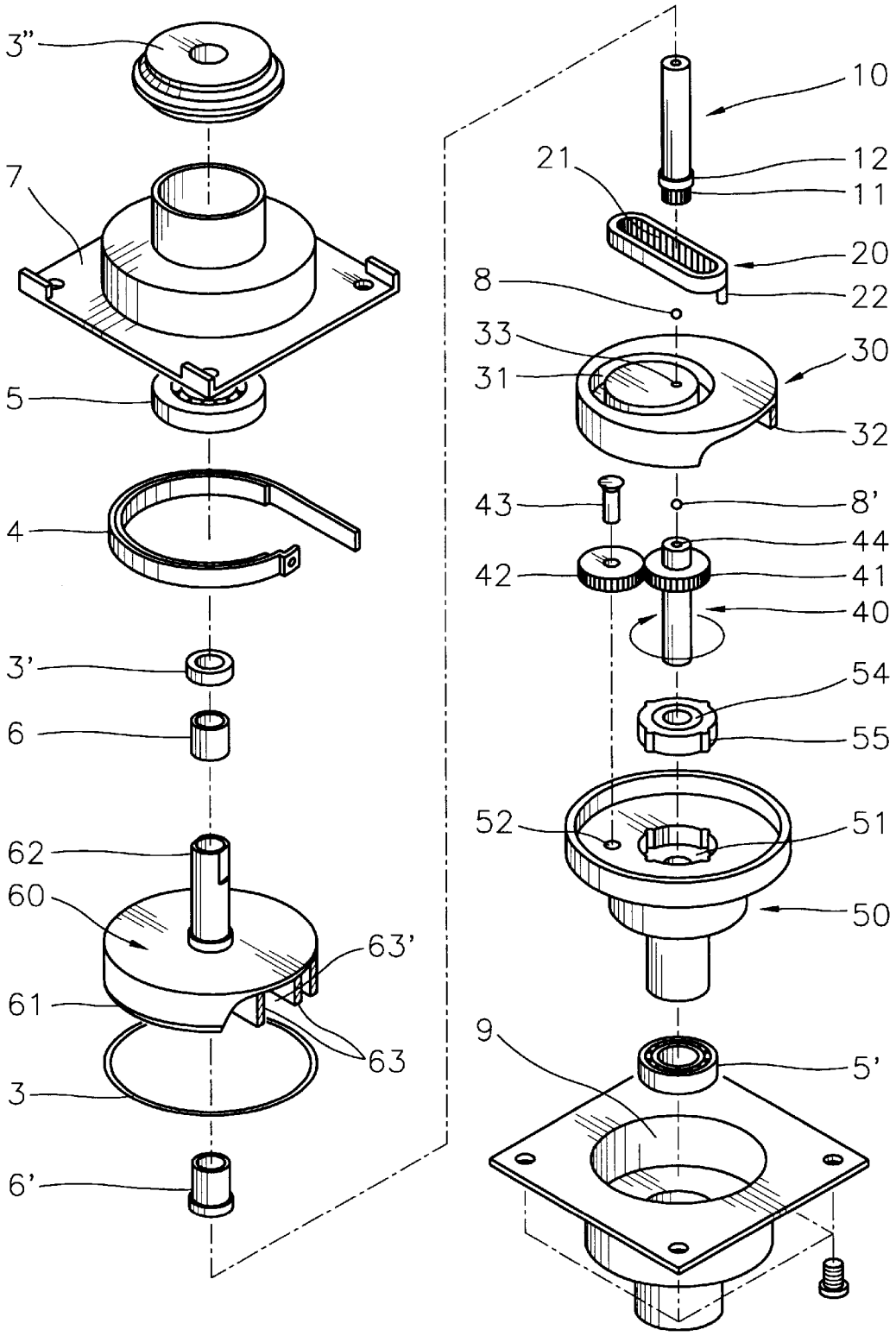
FIG. 1 (PRIOR ART)
FIG. 1 is a exploded perspective view of a washing machine transmission according to the conventional invention.
Figure 2:
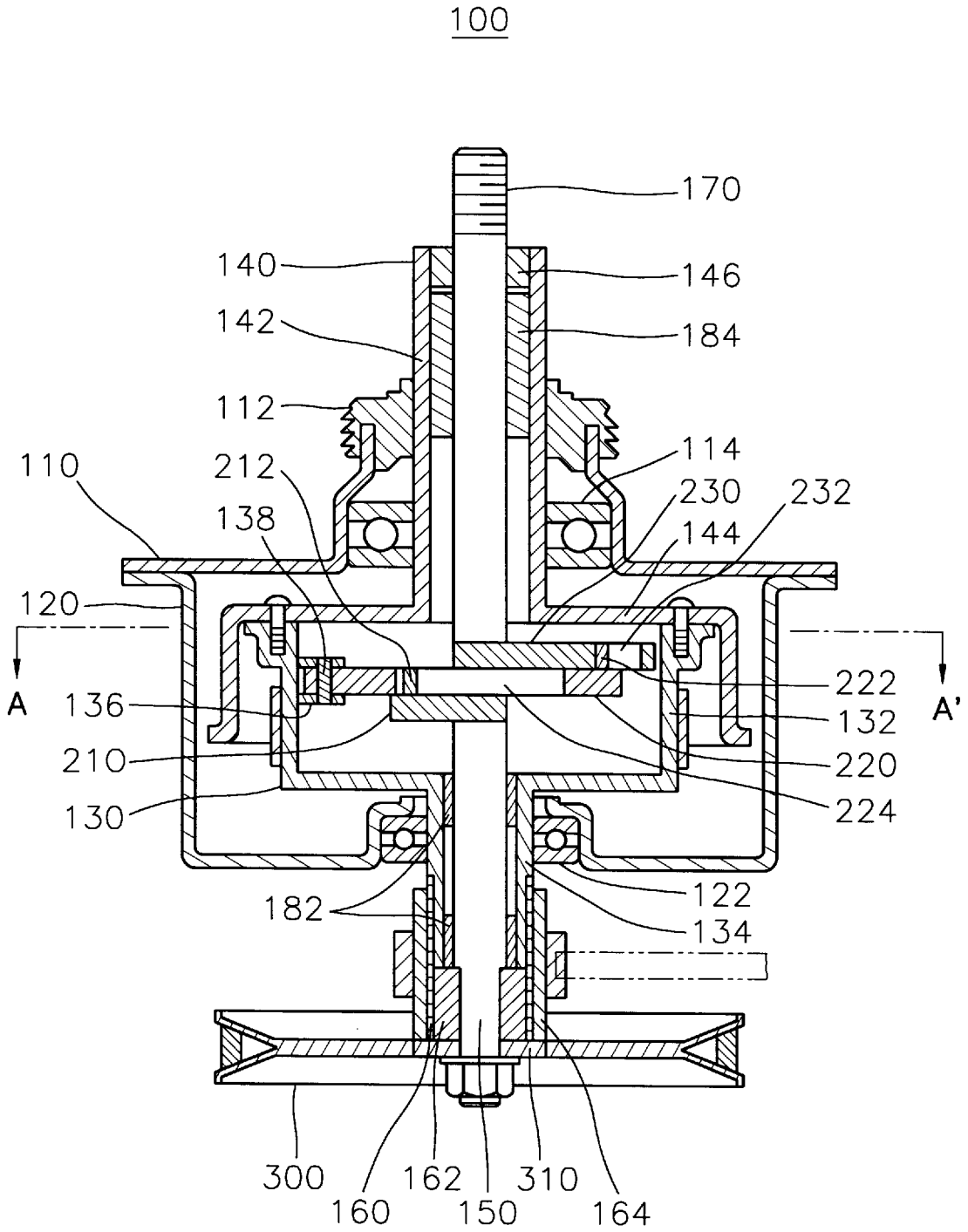
FIG. 2 is a sectional view of a washing machine transmission according to an embodiment of the present invention.

FIG. 2 is a sectional view of a washing machine transmission 100 according to an embodiment of the present invention. In FIG. 2, transmission 100 comprises a housing 120 attached to a lower surface of an outer tub 110, a brake drum 130 extending through the lower surface of housing 120 and supported by housing 120, a spin tub shaft 140 for rotating a spin tub (not shown) in any one direction, in which a lower portion of spin tub shaft 140 is screwed to an upper portion of brake drum 130 and an upper portion of the spin tub shaft 140 is connected to the spin tub, a driving shaft 150 for extending through the brake drum 130 and having power transmitted from a driving source (not shown) through a belt pulley 300 at a lower end of driving shaft 150 so as to rotate in any one direction, a driven shaft 170 for extending through spin tub shaft 140 and being combined with a pulsator (not shown) so as to rotate the pulsator in forward and reverse directions, and a power transmitting mechanism for connecting driving shaft 150 with driven shaft 170 and transmitting a rotation of driving shaft 150, which rotates in one direction, to driven shaft 170 so as to rotate driven shaft 170 in forward and reverse directions.

Also, the washing machine transmission 100 comprises a clutch spring 160 which connects driving shaft 150 with brake drum 130 and transmits the rotation of the driving source to brake drum 130.

Outer tub 110 has a tubular portion extending upward at a center of the lower surface, and has an annular oil sealing member 112 inserted into an upper end. Also, housing 120 is attached to the lower surface of outer tub 110 by welding, etc.. A bearing 114 is inserted in a lower space of the tubular portion of outer tub 110. Spin tub shaft 140 extends through the tubular portion of outer tub 110, through annular sealing member 112, and through bearing 114 inserted in the lower space of tubular portion.

Housing 120 has a bowl shape in which a flange is formed radially on an upper end, and is attached to outer tub 110 in such a manner that the flange is attached to the lower surface of outer tub 110. A circular groove is formed at a center portion of a lower surface of the housing 110, and a through hole is formed at a center portion of the groove. A bearing 122 is inserted into the groove. A shaft portion 134 of the brake drum 130 extends through the through hole and through bearing 122 inserted into the groove. An opening is formed in a cylindrical wall so that a brake band 180 is connected to a brake band control device (not shown) through the opening.

Brake drum 130 comprises a drum portion 132 and a shaft portion 134. A plurality of screwed holes are arranged around an upper edge of drum portion 132 at a predetermined distance. Furthermore, hinge member 136 is attached to the inner surface of drum portion 132. Hinge member 136 comprises two small plates. The plates are vertically attached to one point on the inner surface of drum portion 132 at a predetermined distance apart from each other, and through holes through each of which a hinge pin is inserted into and in which the hinge pin is fixed are formed on each of the plates.

On the other hand, brake band 180 is arranged on the outer peripheral surface of drum portion 132. During a washing cycle, brake band 180 make contact with the outer peripheral surface of drum portion 132 by an operation of a control device (not shown), and prevents brake drum 130 from rotating. Also, during a spin cycle, brake band 180 is released from contact with brake drum 130 by an operation of the control device so that brake drum 130 may rotate.

Shaft portion 134 of brake drum 130 extends downward from the center of the lower surface of drum portion 132 through a through hole formed at the groove of housing 110. Also, a metal bearing 182 is arranged in an inner peripheral surface of shaft portion 134, and driving shaft 150 extends through shaft portion 134 of brake drum 130 and through metal bearing 182.

Spin tub shaft 140 comprises shaft portion 142 and cap portion 144. An upper end of shaft portion 142 is connected to the spin tub. Cap portion 144 is integrated with shaft portion 142 at shaft portion's lower end. Cap portion 144 is similar to drum portion 132 of brake drum 130 in shape, but the diameter of cap portion 144 is larger than that of drum portion 132 and is smaller than that of housing 110. The lower end of cap portion 144 is bent outward. A plurality of through holes are formed at the upper surface of cap portion 144, and correspond to a plurality of screw holes formed at the upper edge of drum portion 132 of brake drum 130 at a predetermined distance apart from each other.

Spin tub shaft 140 is arranged opposite to drum portion 132 in such a manner that plurality of through holes correspond to the screw holes formed on the upper edge of brake drum 130. Then, spin tub shaft 140 is coupled by bolt with brake drum 130. Thus, the power transmitted from the driving source through clutch spring 160 to brake drum 130 is transmitted through spin tub shaft 140 to the spin tub.

A metal bearing 184 is arranged on an upper peripheral surface of shaft portion 142 of spin tub shaft 140, and an annular sealing member 146 is inserted in an upper end above metal bearing 184. Accordingly, metal bearing 184 and annular sealing member 146 support driven shaft 170, which extends through spin tub shaft 140.

Driving shaft 150 extends through shaft portion 134 of brake drum 130, and is supported by metal bearing 182, which is arranged on the inner peripheral surface of shaft portion 134 of brake drum 130. Belt pulley 300 is mounted on the lower portion of driving shaft 150 so that the power is transmitted from the driving source to driving shaft 150. Also, a coupling 162 is arranged between a boss 310 of the belt pulley, which is fixed and joined to driving shaft 150, and the lower end of shaft portion 134 of brake drum 130. Clutch spring 160 is wound around the peripheral surfaces of coupling 162 and shaft portion 134 of brake drum 130, and a clutch boss 164 encloses a periphery of the clutch spring 160.

Clutch spring 160 is released by an operation of a control device (not shown) during the washing cycle, while clutch spring 160 simultaneously makes contact with the peripheral surfaces of coupling 162 and shaft portion 134 of brake drum 130 by an operation of the control device and rotates together with coupling 162 and shaft portion 134 of brake drum 130 during the spin cycle so that power is transmitted from the driving source to spin tub shaft 140.

Driven shaft 170 extends through spin tub shaft 140, and is supported by metal bearing 184 and annular sealing member 146. The pulsator is mounted on an upper portion of driven shaft 170.

The power transmitting mechanism includes a first link 210 attached to driving shaft 150, a second link 220 hinged to brake drum 130, and a third link 230 attached to driven shaft 170. First link 210 is attached at a first end to the upper end of driving shaft 150, and has a first guide pin 212 mounted on a second end. Second link 220 has a through hole formed at a first end so that the hinge pin is inserted into and fixed to the hole, and has a second guide pin 222 mounted on a second end. A first oblong slot 224 is formed between the through hole and second guide pin 222. In the state that a lengthwise axis of second link 220 traverses an axis of the driving shaft 150, the center of first oblong slot 224 coincides with the axis of driving shaft 150, and the length of first oblong slot 224 is larger than the turning radius of first guide pin 212 of first link 210. First end of second link 220 is pivotally hinged to hinge member 136 attached to brake drum 130. First guide pin 212 of first link 210 is inserted into first oblong slot 224 of second link 220. Third link 230 is attached at a first end to the lower end of driven shaft 170, and has a second oblong slot 232 formed at a second end. Second guide pin 222 of second link 220 is inserted into second oblong slot 232 of third link 230. The length of third link 230 is larger than that of first link 210. Also, the length of second oblong slot 232 formed at third link 230 is shorter than that of first oblong slot 224 formed at second link 220.

Figure 3A:
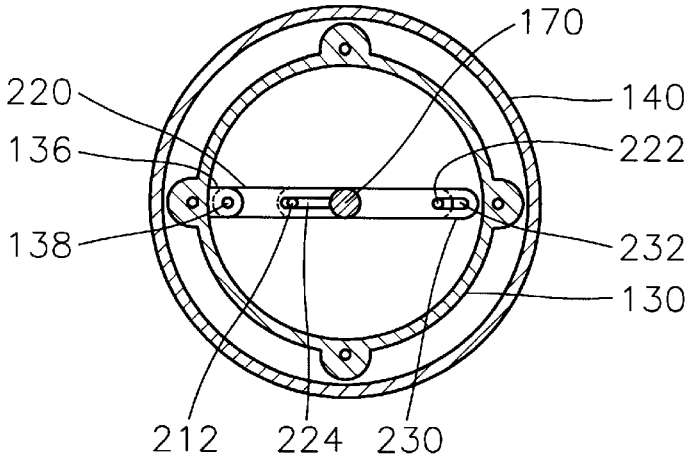
FIGS. 3A to 3C are sectional views which show the operating states of the transmission and which is taken along line A–A' in FIG. 2 of the washing machine transmission according to the embodiment of the present invention.
Figure 3B:
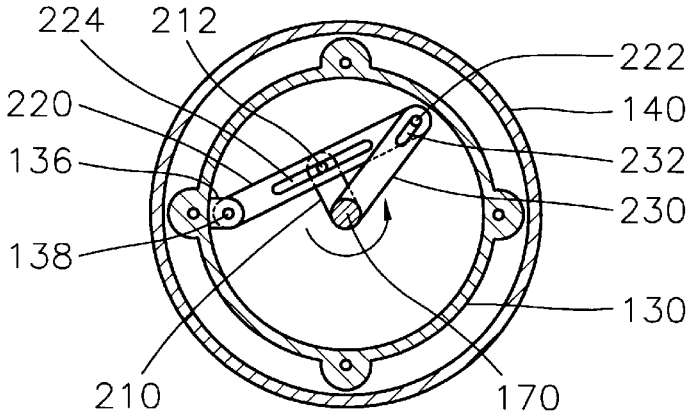
Figure 3C:
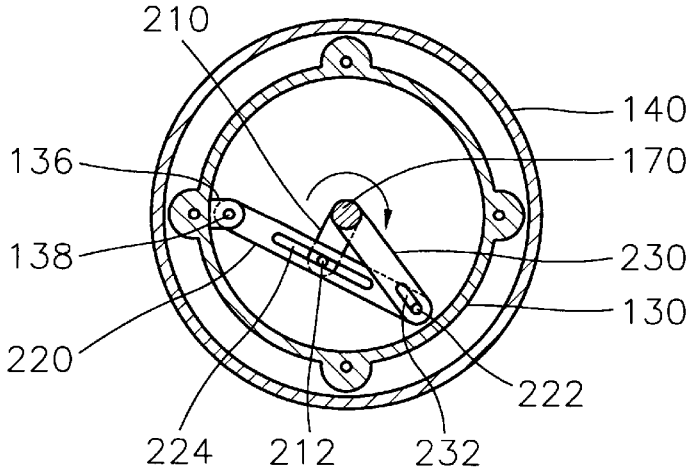

FIGS. 3A to 3C are sectional views which show the operating states of washing machine transmission 100 and is taken along line A–A' in FIG. 2 of washing machine transmission 100. FIG. 3A shows a state where first link 210, second link 220, and third link 230 are arranged linearly. FIGS. 3B and 3C show a state where a rotating angle of the second link 220 with respect to a line traversing the axis of hinge member 136 and driving shaft 150 is at its maximum, second link 220 rotates when first link 210 rotates in any one direction. When the angle between first link 210 and second link 220 is 90°, the rotating angle of second link 220 is a maximum.

Hereinafter, the operation of each of the elements of washing machine transmission 100 of the present invention described above will be described.

In the washing machine transmission 100 according to the present invention, which is illustrated above, the power is transmitted from the driving source through belt pulley 300 to driving shaft 150 when the driving source rotates in any one direction during the washing cycle. At that time, a brake band control device operates so that brake band 180 makes contact with brake drum 130, so that brake drum 130 is prevented from rotating. Thus, spin tub shaft 140 coupled with brake drum 130 and spin tub mounted on an upper end of spin tub shaft 140 do not rotate. On the other hand, driving shaft 150, which has power transmitted from the driving source, rotates in the same direction as a rotating direction of the driving source, and first link 210 attached to the upper end of driving shaft 150 also rotates in a circle around the axis of driving shaft 150. Therefore, first guide pin 212 mounted on second end of first link 210 rotationally guides first oblong slot 224 of second link 220 hinged to brake drum 130. Thus, second link 220 rotates in forward and reverse directions around a hinge point in a predetermined range of angles.

Since third link 230 connects to second link 220 in such a manner that the first end of third link 230 is attached to driven shaft 170, which is concentric with driving shaft 150, and the second end of third link 230 is connected with second guide pin 222 of second link 220 through second oblong slot 232, when second link 220 rotates in forward and reverse directions around the hinge point, third link 230 rotates in forward and reverse directions around the axis of the driven shaft 170 in the predetermined range of angles. At this time, the angle range of third link 230 is larger than the angle range of second link 220. Thus, the pulsator mounted on the upper end of third link 230 rotates in the range of angles in which third link 230 rotates in forward and reverse directions.

During the spin cycle, as a result of a control signal of an ECU (Electronic Control Unit), the clutch spring control device operates so that clutch spring 160 makes contact with coupling 162 attached to a lower portion of driving shaft 150 and to a lower portion of brake drum 130 connected to spin tub shaft 140. At this time, brake band 180, which has been braking brake drum 130, releases brake drum 130. Thus, the power of the driving source is transmitted to driving shaft 150 and spin tub shaft 140, so the spin tub rotates, the spin cycle is performed. Of course, since the ECU only operates the clutch spring control device during the washing cycle, clutch spring 160 is now in the released state. Therefore, the power of the driving source is transmitted to the pulsator through driving shaft 150 and driven shaft 170 only during the washing cycle in order to perform the washing cycle.

As described above, the washing machine transmission according to the present invention can perform the washing by rotating the pulsator in forward and reverse directions during a washing cycle even through the driving source rotates only in any one direction, and can perform the spinning by rotating the pulsator and the spin tub simultaneously in the same direction as the rotating direction of the driving source during the spinning cycle. Thus, the overload in the driving source can be prevented and the life of the driving source can be extended.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. A washing machine transmission comprising:

a housing mounted on a lower portion of an outer tub;

a brake drum extending through a lower surface of the housing and supported by the housing;

a spin tub shaft connected to the spin tub at an upper portion of the spin tub shaft and screwed to an upper portion of the brake drum at a lower portion of the spin tub shaft for rotating a spin tub in a first direction;

a driving shaft extending through the brake drum, coupled with a belt pulley at a lower end of the driving shaft, and rotatable in the first direction, for receiving a power transmitted from a driving source;

a driven shaft extending through the spin tub shaft and coupled with a pulsator at an upper end of the driven shaft for rotating the pulsator in forward and reverse directions; and a power transmitting means for connecting the driving shaft to the driven shaft, for transmitting a rotation of the driving shaft, which rotates in the first direction, to the driven shaft, and for rotating the driven shaft in the forward and reverse directions, said power transmitting means having a first link attached at a first end to an upper end of the driving shaft for rotating with the driving shaft, a second link hinged to an inner peripheral surface of the brake drum at a first end of the second link and connected to said first link for rotating in the forward and reverse directions in a predetermined range of angles according to a rotation of said first link, and a third link attached to the driven shaft at a first end of said third link and coupled with said second link at a second end of said third link for rotating in the forward and reverse directions.

2. A washing machine transmission as claimed in claim 1, wherein a first guide pin, which guides said second link, is mounted on a second end of said first link.

3. A washing machine transmission as claimed in claim 1, wherein said second link has a through hole for a hinge joint formed at said first end and has a second guide pin mounted on a second end of said second link, wherein a first oblong slot is formed between the through hole and said second guide pin so that said first guide pin of said first link is movably inserted into said first oblong slot.

4. A washing machine transmission as claimed in claim 3, wherein said first link is shorter in length than said second link.

5. A washing machine transmission as claimed in claim 1, wherein a second oblong slot is formed at the second end of said third link so that said second guide pin of said second link is movably inserted into said second oblong slot.

6. A washing machine transmission as claimed in claim 5, wherein said second oblong slot is shorter in length than said first oblong slot.

7. A washing machine transmission as claimed in claim 1, wherein said range of angle in which said third link rotates in the forward and reverse directions is larger than the range of angles in which said second link rotates in the forward and reverse directions.

8. A washing machine transmission as claimed in claim 1, further comprising a clutch spring for connecting said driving shaft with said brake drum so that a power is transmitted to said brake drum.

9. A washing machine transmission as claimed in claim 8, wherein an upper portion of said clutch spring is wound around an outer peripheral surface of a shaft portion of said brake drum.

10. A washing machine transmission comprising:

a housing mounted on a lower portion of an outer tub;

a brake drum extending through a lower surface of the housing and supported by the housing;

a spin tub shaft which is connected to the spin tub at an upper portion of the spin tub shaft and is screwed to an upper portion of the brake drum at a lower portion of the spin tub shaft, for rotating a spin tub in a first direction;

a driving shaft which extends through the brake drum, is coupled with a belt pulley at a lower end of the driving shaft, and rotates in the first direction for having a power transmitted from a driving source;

a driven shaft which extends through the spin tub shaft and is coupled with a pulsator at an upper end of the driven shaft, for rotating the pulsator in forward and reverse directions;

a clutch spring for connecting said driving shaft with said brake drum so that the power is transmitted to said brake drum; and a power transmitting means for connecting the driving shaft and the driven shaft, for transmitting a rotation of the driving shaft, which rotates in the first direction to the driven shaft, and for rotating the driven shaft in the forward and reverse directions, wherein the power transmitting means comprises a first link which is attached at a first end to an upper end of the driving shaft, for rotating with the driving shaft, a second link which is hinged to an inner peripheral surface of the brake drum at a first end of the second link and is connected to said first link, for rotating in forward and reverse directions in a predetermined range of angles according to a rotation of said first link, and a third link which is attached to the driven shaft at a first end of said third link and is coupled with said second link at a second end of said third link, for rotating in the forward and reverse directions.

11. A washing machine transmission as claimed in claim 10, wherein a first guide pin, which guides said second link, is mounted on a second end of said first link.

12. A washing machine transmission as claimed in claim 10, wherein said second link has a through hole for a hinge joint formed at said first end and has a second guide pin mounted on a second end, wherein a first oblong slot is formed between said through hole and said second guide pin so that said first guide pin of said first link is movably inserted into said first oblong slot.

13. A washing machine transmission as claimed in claim 12, wherein said first link is shorter in length than said second link.

14. A washing machine transmission as claimed in claim 10, wherein a second oblong slot is formed at the second end of said third link so that said second guide pin of said second link is movably inserted into said second oblong slot.

15. A washing machine transmission as claimed in claim 14, wherein said second oblong slot is shorter in length than said first oblong slot.

16. A washing machine transmission as claimed in claim 10, wherein said range of angles in which said third link rotates in the forward and reverse directions is larger than said range of angles in which said second link rotates in the forward and reverse directions.

17. A washing machine transmission as claimed in claim 10, wherein an upper portion of said clutch spring is wound around an outer peripheral surface of a shaft portion of said brake drum, wherein a lower portion of said clutch spring is wound around a coupling mounted on the driving shaft, and wherein a periphery of said clutch spring is enclosed by a clutch boss.

18. A washing machine transmission comprising:

a housing mounted on a lower portion of an outer tub;

a brake drum extending through a lower surface of the housing and supported by the housing;

a spin tub shaft which is connected to the spin tub at an upper portion of the spin tub shaft and is screwed to an upper portion of the brake drum at a lower portion of the spin tub shaft for rotating a spin tub in a first direction;

a driving shaft which extends through the brake drum, is coupled with a belt pulley at a lower end of the driving shaft, and rotates in the first direction for having a power transmitted from a driving source;

a driven shaft which extends through the spin tub shaft and is coupled with a pulsator at an upper end of the driven shaft, for rotating the pulsator in forward and reverse directions;

a clutch spring for connecting said driving shaft with said brake drum so that power is transmitted to said brake drum, wherein an upper portion of said clutch spring is wound around an outer peripheral surface of a shaft portion of said brake drum, wherein a lower portion of said clutch spring is wound around a coupling mounted on the driving shaft, and wherein a periphery of said clutch spring is enclosed by a clutch boss; and a power transmitting means for connecting the driving shaft and the driven shaft, for transmitting a rotation of the driving shaft which rotates in the first direction to the driven shaft, and for rotating the driven shaft in the forward and reverse directions, wherein said power transmitting means comprises a first link which is attached at a first end to an upper end of the driving shaft and has a first guide pin mounted on a second end of said first link, for rotating with the driving shaft, a second link which is hinged to an inner peripheral surface of the brake drum at a first end of the second link, which has a second guide pin mounted on a second end of said second link, which has a first oblong slot formed between said first end and said second end, and which is connected to said first guide pin of said first link, and a third link which is attached to a lower end of the driven shaft at a first end of said third link, which has a second oblong slot formed at a second end, and which is coupled with said second link.

* * * * *